US006547414B2

(12) United States Patent
Steger

(10) Patent No.: US 6,547,414 B2
(45) Date of Patent: Apr. 15, 2003

(54) FOCUSING WATERPROOF FLASHLIGHT

(76) Inventor: Wilfried Steger, 7 Wing Hong Street, Suite A, 11/4 Westgate Tower, Cheung Sha Wan, Hong Kong (CN)

( * ) Notice: Subject to any disclaimer, the term of this patent is extended or adjusted under 35 U.S.C. 154(b) by 0 days.

(21) Appl. No.: 09/925,437

(22) Filed: Aug. 9, 2001

(65) Prior Publication Data

US 2002/0018343 A1 Feb. 14, 2002

Related U.S. Application Data

(60) Provisional application No. 60/224,820, filed on Aug. 11, 2000.

(51) Int. Cl.[7] ..... F21L 4/00

(52) U.S. Cl. ..... 362/188; 362/158; 362/194; 362/204

(58) Field of Search ..... 362/188, 187, 362/194, 204, 205, 158, 208; 200/60, 302.2, 302.3, 329, 332.1, 341

(56) References Cited

U.S. PATENT DOCUMENTS 2,516,993 A 8/1950 Holt
3,603,783 A * 9/1971 Schwartz ..... 362/188
3,689,759 A 9/1972 Dill
3,794,825 A * 2/1974 Krupansky ..... 362/158
4,152,755 A 5/1979 Trosper et al.
4,531,178 A * 7/1985 Uke ..... 200/60
5,171,086 A 12/1992 Baloochi
5,826,971 A 10/1998 Kibler
5,865,525 A 2/1999 Kibler et al.

* cited by examiner

*Primary Examiner*—Stephen Husar
*Assistant Examiner*—John Anthony Ward
(74) *Attorney, Agent, or Firm*—William M. Hobby, III

(57) ABSTRACT

An underwater flashlight has an adjustable focusing beam and a waterproof battery pack which can be removably changed underwater. The flashlight includes a watertight housing having a slidably mounted lamp therein slidable by an external sliding focus member having a permanent magnet mounted therein. The permanent magnet moves an internal sliding focusing member also having a magnet therein coacting with the external magnet. The slidable inside focusing member is connected by a link to the lamp for moving the lamp into and out of a reflector when focusing the lamp. An on/off switch is attached to the slidable outside focusing member and has a magnet mounted therein for actuating a pickup coil attached to the slidable inside focusing member. The flashlight includes a waterproof attachable battery pack which has a magnetic switch therein actuated by a magnet in the watertight housing of the flashlight so that the batteries do not provide an electrical connection until the contacts are brought together.

17 Claims, 2 Drawing Sheets

FOCUSING WATERPROOF FLASHLIGHT

This application claims the benefit of Provisional application Ser. No. 60/224,820, filed Aug. 11, 2000.

BACKGROUND OF THE INVENTION

The present invention relates to a flashlight which uses a slidable switch for adjusting the focus and for actuating the lamp in the flashlight and to a waterproof flashlight in which the batteries can be changed under water.

In the past, there have been a wide variety of underwater lanterns or flashlights and flashlights which can be focused through a sliding switch. In the Schwartz U.S. Pat. No. 3,603,783, a flashlight has a magnetic lamp focusing and switching by means of a single externally controlled magnet which coacts with an internal hard-wired hermetically sealed magnetic reed switch to control actuation of the lamp and an internal magnetic member for providing lamp position adjustment for focus control. The Dill U.S. Pat. No. 3,689,759 and the Krupansky U.S. Pat. No. 3,794,825 are both underwater flashlights which use a magnetic switch to actuate the flashlight and for adjusting the light beam. The Trosper et al. U.S. Pat. No. 4,152,755 is a portable magnetically actuated flashlight. The prior art Holt U.S. Pat. No. 2,516,993 and to Kibler et al. U.S. Pat. No. 5,865,525 and to Kibler U.S. Pat. No. 5,826,971 and to Baloochi U.S. Pat. No. 5,171,086 all teach hand-held adjustable focus flashlights.

The present invention has a combination switch which is slid to focus the lamp in an underwater flashlamp while pushing on the switch will actuate the lamp. Permanent magnets are utilized to operate the switching and focusing through a waterproof surface in order to main the waterproof integrity of the underwater flashlight. The flashlight also advantageously allows the batteries to be changed underwater without affecting the waterproof integrity of the operating components of the flashlight.

SUMMARY OF THE INVENTION

An underwater flashlight has an adjustable focusing beam and a waterproof battery pack which can be removably changed underwater. The flashlight includes a watertight housing having a slidably mounted lamp therein slidable by an external sliding focus member having a permanent magnet mounted therein. The permanent magnet moves an internal sliding focusing member also having a magnet therein coacting with the external magnet. The slidable inside focusing member is connected by a link to the lamp for moving the lamp into and out of a reflector when focusing the lamp. An on/off switch is attached to the slidable outside focusing member and has a magnet mounted therein for actuating a pickup coil attached to the slidable inside focusing member. The flashlight includes a waterproof attachable battery pack which has a magnetic switch therein actuated by a magnet in the watertight housing of the flashlight so that the batteries do not provide an electrical connection until the contacts are brought together and the magnetic switch activated.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
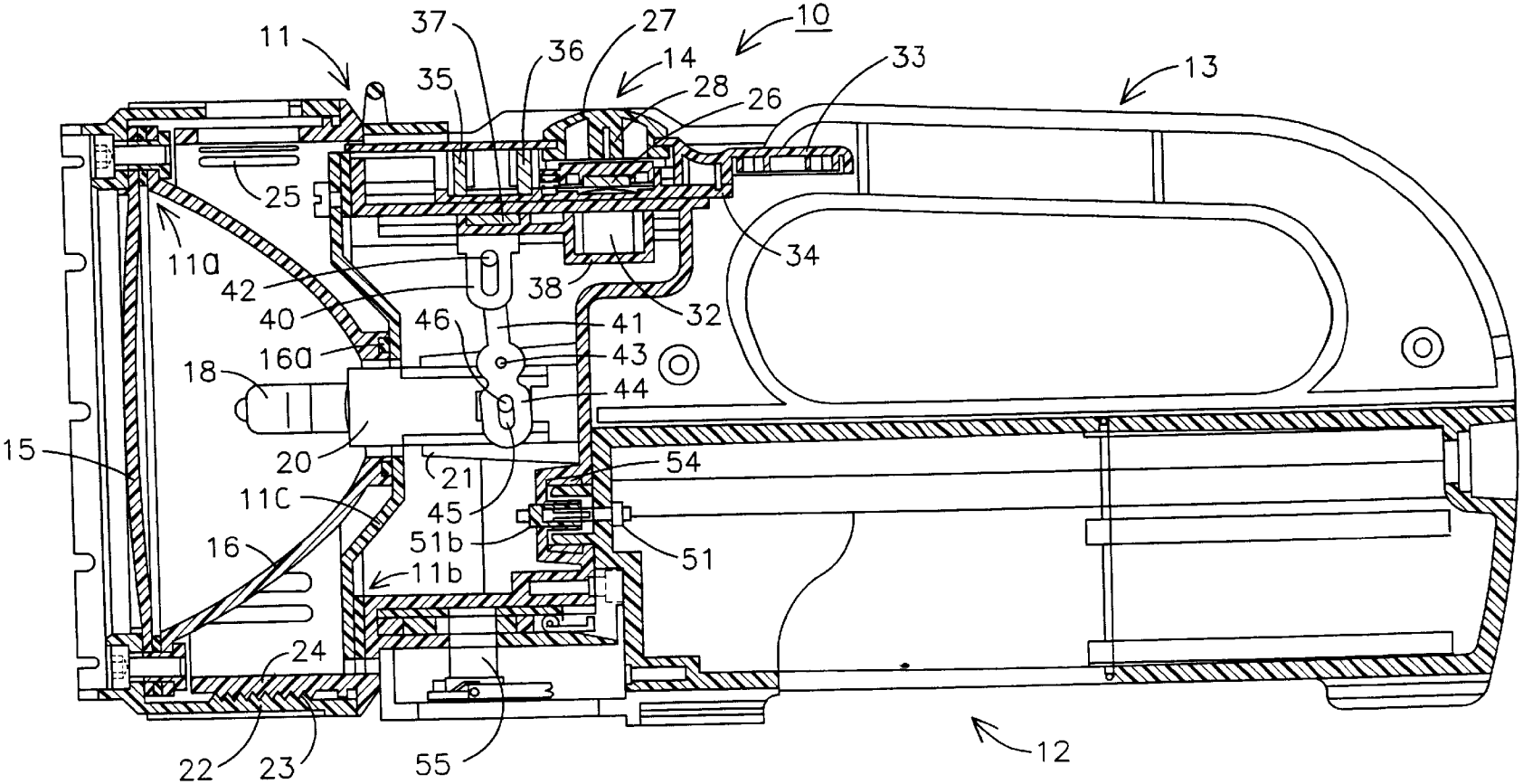
FIG. 1 is a sectional view of a waterproof focusable flashlight in accordance with the present invention.
Figure 2:
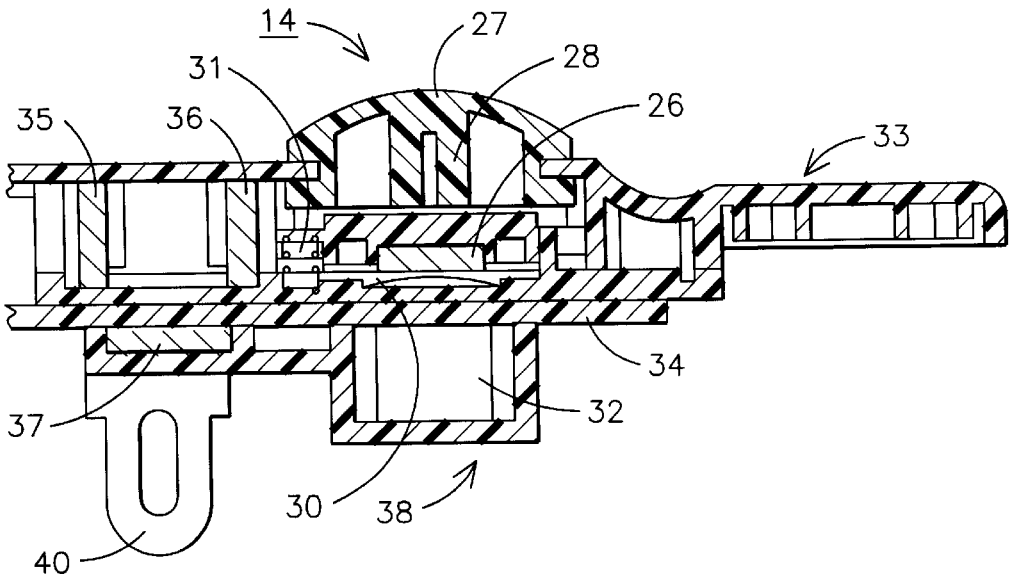
FIG. 2 is a sectional view of a slidable focusing and on/off switch combination in accordance with the flashlight of FIG. 1.
Figure 3:
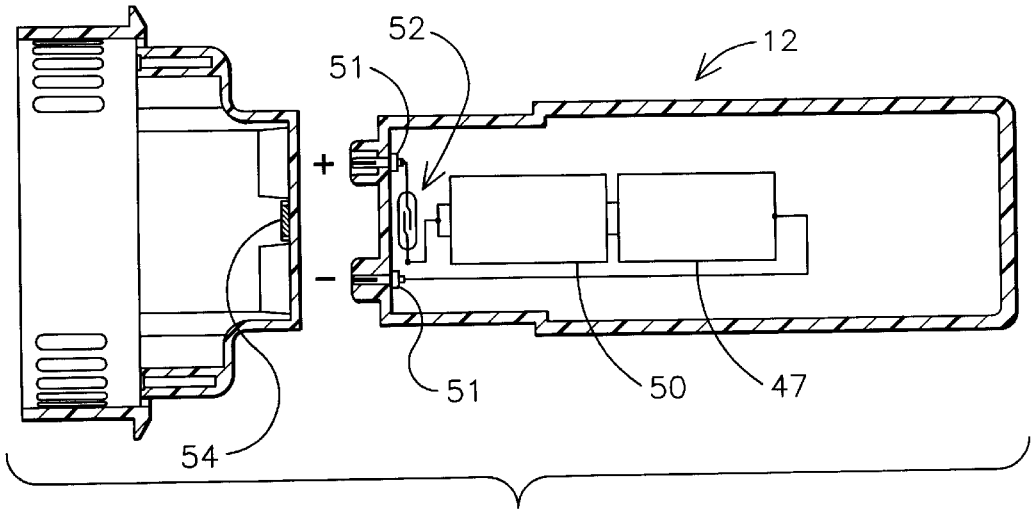
FIG. 3 is a sectional view of the battery housing and connection for the flashlight.

Referring to the drawings FIGS. 1–3, a waterproof flashlight 10 is illustrated having a lamp housing 11 along with a battery housing 12 and a handle 13. A focusing slide combined with an on/off switch assembly 14 is illustrated in FIGS. 1 and 2. The flashlight 10 has its lens 15 tightly clamped between the threaded cover 22, rubber seal 11*a* and the wider opening of the parabolic reflector 16 by means of a circular array of threaded screws and nuts made of stainless steel. A deep drawn aluminum disc 11*c* constitutes the one member of the sealing construction assembly which is to seal off the open end of the front casing 11 by means of an underlaid rubber seal 11*b* and a circular array of screws engaging the rim of front casing 11. The central aperture in disc 11*c* and the opening at the smaller end of the parabolic reflector 16, together with O-ring 16*a*, combine into a channel and so create a hermetically sealed larger cavity whenever threads 23 of threaded cover 22 engage the threads 24 of front casing 11, thus pressing O-ring 16*a* against disc 11*c*. A bulb 18 is slidably mounted to a support 20 supported in a channel 21 of the front casing 11. The front casing 11 has a plurality of openings 25, therethrough around the reflector 16, in alignment with the same number of openings around the threaded cover 22 to allow for the flow through of water or air convection cooling of the reflector.

The slidable switch assembly 14 has a magnet 26 mounted below a dome shaped, soft elastomeric switch member 27 which is pushed to push the extensions 28 against a return spring 31 and against a snap disc 30 with defined stroke and snap-point force. Whenever the vertical pushing force of switch member 27 equals or exceeds snap-point force of snap disc 30, a rapid, toggle-like movement will drive magnet 26 over the defined stroke of snap disc 30 and thus induces a voltage spike in the pickup coil 32 inside the hermetically sealed front casing 11. This voltage spike in turn is registered by an electronic assembly inside the front casing 11 which simulates a spark free on/off switch. Pick-up coil 32 may be replaced by a reed switch. Depressing the handle portion 27 to push the magnet 26 a second time turns the lamp 18 off.

The sliding switch portion 33 is supported over a waterproof wall section 34 and includes a pair of magnets 35 and 36 which will engage a magnet 37 on the opposite side of the wall 34 so that when the sliding switch portion 33 is slid along the waterproof wall 34, the magnets 35 and 36 will engage the magnet 37 and slide the lower switch body 38 thereby sliding the yoke 40. Movement of the yoke 40 moves a link 41 which is pinned thereto with a pin 42 and in turn is pinned with pin 43 to a second link 44 which has a yoke 45 which engages a pin 46 on the sliding body portion holding the lamp 18. Thus, sliding of the switch body portion 33 will slide the yoke 40 and in turn slide the linkage 41 and 44 to slide the bulb 18 for making adjustments to the focus.

The entire slide assembly 33 is moved back and forth, as seen in FIG. 1, on the waterproof wall 34 to thereby pull the lower switch portion 38 sliding it back and forth while always maintaining the ON/OFF switch portion 27 along the magnet 36 aligned over the ON/OFF switch portion 32.

The hermetically sealed battery casing 12 contains rechargeable batteries 47 connected in series in the casing. One pole of the front battery 50 is connected to the waterproof mounted feed-through contact pin 51, in series with reed switch 52 located midway between the pair of contact pins 51. Reed switch 52, normally open, is actuated and electrically connected by the magnetic force of a permanent magnet 54 mounted on the inner side of the adjacent wall of front casing 11 if a battery casing 12 is slid along the guide rails of the lower portion of handle 13. An electric connection is thus being established via two waterproof feeds through sockets 51*b* molded into the back wall of front casing 11 and being in alignment with pins 51 molded into the adjacent battery casing 12. The battery electrically couples to an electronic assembly housed in front casing 11 and current flow is established by means of a solid state semiconductor drive which sparklessly turns bulb 18 on or off by a control signal generated in the pickup coil 32.

Two rubber seals 54 liken a cone-shaped tubular section which tightly fit around the circular protruding portions of the front of battery casing 12. The establishment of electric contact of the battery casing 12 with the electronic assembly inside the front casing is accompanied by mechanically engaging and locking of a cam mechanism 55 which pulls the battery casing 12 with a certain force in its axial direction, thus causing seals 54 to compress and expand laterally so that excess water surrounding contact pins 51 and sockets 51*b* will be squeezed out. The reed switch is released when the battery casing 12 is mechanically disengaged and removed for charging.

It should be clear at this time that a waterproof flashlight has been provided which advantageously allows the changing of the batteries underwater and which has a single slide switch which uses permanent magnets to adjust the focus of the lamp and which simultaneously allows for an ON/OFF switch of the lamp. However, the present invention is not to be construed as limited to the forms shown which are to be considered illustrative rather than restrictive.

I claim:

1. An underwater flashlight with an adjustable focusing beam comprising:

a watertight housing having an inside and an outside and a lamp supporting bore therein;

a lamp switch mounted to the outside of said housing;

a battery pack removably attached to said watertight housing;

a lamp slidably mounted in said housing lamp supporting bore, said lamp being operatively connected to said battery pack through said lamp switch;

a slidable outside focusing member slidably mounted to said housing on the outside thereof and having a permanent magnet mounted thereto;

a slidable inside focusing member slidably mounted to said housing on the inside thereof and having a permanent magnet mounted therein positioned to be moved by sliding said slidable outside focusing member to move said magnet mounted thereto while magnetically engaging said inside focusing member magnet; and a link having two end portions and being movably connected to said lamp on one end portion thereof, and to said slidable inside focusing member on the other end portion thereof, said link being rotatably attached to a hinge pin between the end portions of said link to thereby slide said lamp when moving said slidable inside focusing member;

whereby movement of said outside focusing member slides said inside focusing member and focusing link to focus said lamp.

2. An underwater flashlight with an adjustable focusing beam in accordance with claim 1 having a pickup coil mounted inside said watertight housing and having a magnet movably mounted in said lamp switch for actuating said pickup coil.

3. An underwater flashlight with an adjustable focusing beam in accordance with claim 2 in which said lamp switch is mounted in said slidable outside focusing member.

4. An underwater flashlight with an adjustable focusing beam in accordance with claim 3 in which said pickup coil is mounted in said slidable inside focusing member.

5. An underwater flashlight with an adjustable focusing beam in accordance with claim 4 in which said lamp switch is movably mounted against a return spring in said slidable outside focusing member.

6. An underwater flashlight with an adjustable focusing beam in accordance with claim 1 in which said lamp includes a lamp housing supporting a bulb therein, said lamp housing having a link connecting pin thereon having said link mounted thereto.

7. An underwater flashlight with an adjustable focusing beam in accordance with claim 6 in which said housing has a reflector attached thereto and said lamp housing is slidably mounted in said lamp supporting bore and having said bulb protruding into said reflector.

8. An underwater flashlight with an adjustable focusing beam in accordance with claim 7 in which said slidable inside focusing member has a link yoke attached thereto having said link movably attached therein.

9. An underwater flashlight with an adjustable focusing beam in accordance with claim 1 in which said battery pack includes at least one battery having two battery poles and being mounted in a waterproof housing removably attached to said watertight housing and having at least one electrical contact mounted to said battery housing.

10. An underwater flashlight with an adjustable focusing beam in accordance with claim 9 in which said battery pack includes a magnetically actuated switch inside said waterproof housing connected between one said battery pole and a battery pack waterproof housing electrical contact.

11. An underwater flashlight with an adjustable focusing beam in accordance with claim 10 in which said watertight housing has at least one electrical contact on the outside of said housing for making electrical contact with said battery housing electrical contact.

12. An underwater flashlight with an adjustable focusing beam in accordance with claim 11 in which said watertight housing has a magnet mounted therein adjacent said at least one electrical contact positioned to actuate said magnetically actuated switch inside said waterproof battery housing when said watertight housing at least one electrical contact is brought into contact with said waterproof battery housing electrical contact.

13. An underwater flashlight with an adjustable focusing beam comprising:

a watertight housing having an inside and an outside and a lamp supporting bore therein;

a lamp switch mounted to the outside of said housing;

a battery pack removably attached to said watertight housing, said battery pack having at least one battery having two battery poles and being mounted in a waterproof housing removably attached to the outside of said watertight housing and having at least one electrical contact mounted to said battery housing, said battery pack having a magnetically actuated switch inside said waterproof housing connected between one said battery pole and a battery pack waterproof housing electrical contact whereby said battery pack is not actuated until said magnetically actuated switch is actuated upon connecting said battery pack to said flashlight watertight housing;

a lamp slidably mounted in said housing lamp supporting bore, said lamp being operatively connected to said battery pack through said lamp switch;

a slidable outside focusing member slidably mounted to said housing on the outside thereof and having a permanent magnet mounted thereto;

a slidable inside focusing member slidably mounted to said housing on the inside thereof and having a permanent magnet mounted therein positioned to be moved by sliding said slidable outside focusing member to move said magnet mounted thereto while magnetically engaging said inside focusing member magnet; and a link having two end portions and being movably connected to said lamp on one end portion thereof, and to said slidable inside focusing member on the other end portion thereof;

whereby movement of said outside focusing member slides said inside focusing member and focusing link to focus said lamp.

14. The underwater flashlight with an adjustable focusing beam in accordance with claim 13 in which said watertight housing has at least one electrical contact on the outside of said housing for making electrical contact with said battery housing electrical contact.

15. The underwater flashlight with an adjustable focusing beam in accordance with claim 13 in which said link is rotatably pinned to said housing between the end portions thereof.

16. The underwater flashlight with an adjustable focusing beam in accordance with claim 15 in which said lamp includes a lamp housing supporting a bulb therein, said lamp housing having a link connecting pin thereon having said link attached thereto.

17. The underwater flashlight with an adjustable focusing beam in accordance with claim 13 having a pickup coil mounted inside said watertight housing and having a magnet movably mounted in said lamp switch for actuating said pickup coil.

* * * * *